US005893672A

United States Patent [19]

Erickson

[11] Patent Number: 5,893,672

[45] Date of Patent: Apr. 13, 1999

[54] VISCID SUBSTANCE RECOVERY AND DISPENSER DEVICE

[76] Inventor: Deidre Kaye Erickson, 1400 N. Lake Shore Dr., Apt. 7J, Chicago, Ill. 60610

[21] Appl. No.: 08/760,921

[22] Filed: Dec. 6, 1996

[51] Int. Cl.[6] ..... A45D 40/00; A45D 40/14; A45D 40/18

[52] U.S. Cl. ..... 401/52; 401/61; 401/63; 401/64

[58] Field of Search ..... 401/52, 63, 64, 401/61; 30/113.1, 113.3

[56] References Cited

U.S. PATENT DOCUMENTS

| | | | |
|---|---|---|---|
| 1,906,967 | 5/1933 | Houlihan . | |
| 2,013,308 | 9/1935 | Hickox | 401/61 |
| 2,108,512 | 2/1938 | Reichenbach | 401/61 X |
| 2,393,677 | 1/1946 | Gelardin | 401/61 |
| 2,600,811 | 6/1952 | Suinat | 401/61 |
| 2,858,937 | 11/1958 | Hoffman | 206/56 |
| 3,343,668 | 9/1967 | Politzer | 206/56 |
| 3,348,670 | 10/1967 | Bau | 206/568 |
| 3,677,654 | 7/1972 | Davis | 401/634 |
| 4,099,518 | 7/1978 | Baylis et al. | 30/113.1 X |
| 4,310,969 | 1/1982 | Cannizzaro | 30/113.1 |
| 4,903,407 | 2/1990 | Fischer | 30/113.1 |
| 4,905,375 | 3/1990 | Braswell | 30/113.1 |
| 5,033,893 | 7/1991 | Hainaut | 401/558 |

FOREIGN PATENT DOCUMENTS

| | | | |
|---|---|---|---|
| 694722 | 12/1930 | France | 401/61 |
| 1591941 | 9/1990 | Russian Federation | 30/113.1 |

*Primary Examiner*—Steven A. Bratlie
*Attorney, Agent, or Firm*—Fitch, Even, Tabin & Flannery

[57] ABSTRACT

There is provided a device for recovering and dispensing the unusable portion of a pasty substance, such as that of a personal health and beauty product, that is located in the base portion of the original packaging. The device includes a casing having a closed end, an open end and a wall extending between the closed end and the open end. An extractor is associated with the casing and has a predetermined cross-section and an inner surface that cooperate to exert gripping forces to maintain a pasty substance in the extractor. There is a dispenser also associated with the casing and operable to overcome the gripping forces of the extractor to expel a pasty substance being maintained in the extractor.

25 Claims, 4 Drawing Sheets

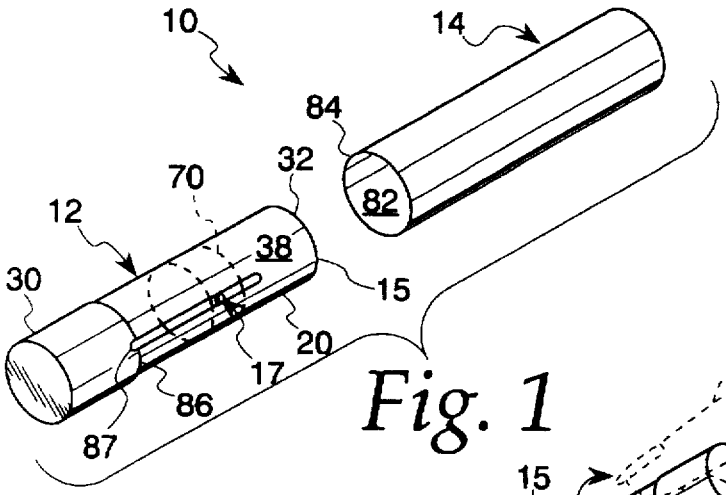
Fig. 1
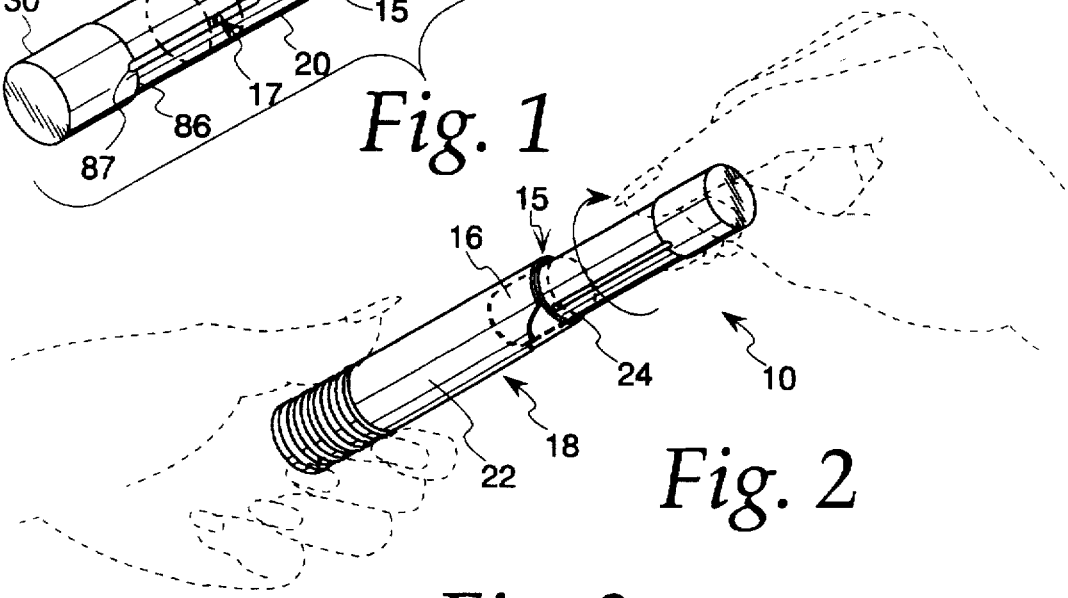
Fig. 2
Fig. 3
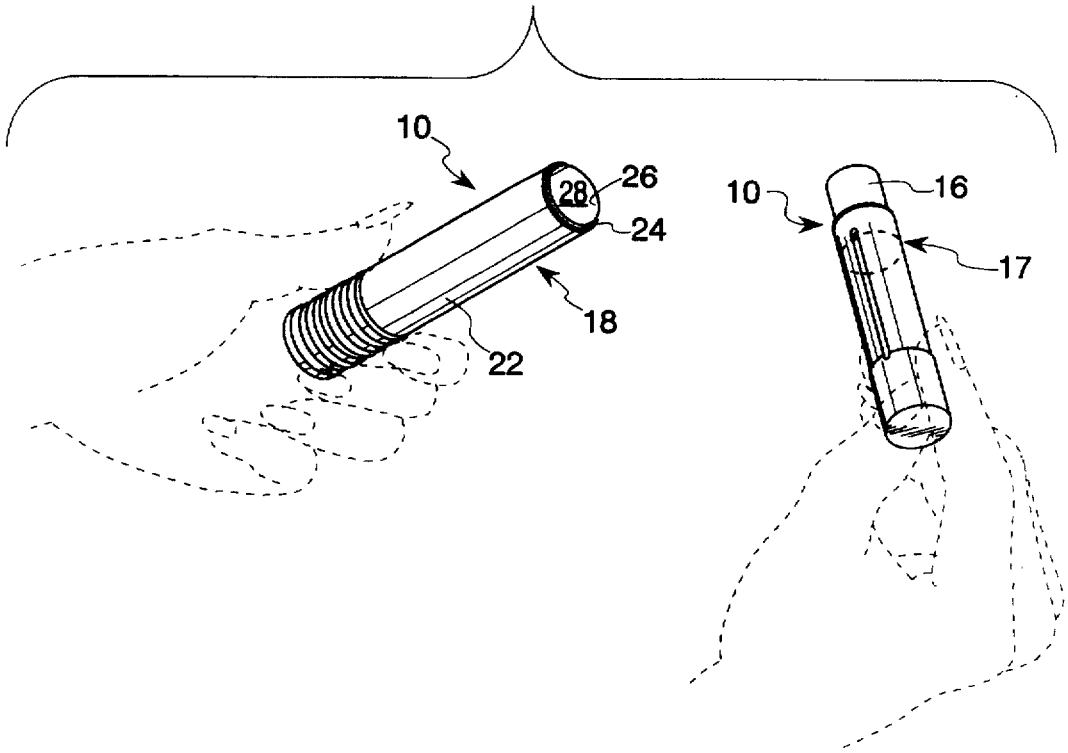

VISCID SUBSTANCE RECOVERY AND DISPENSER DEVICE

FIELD OF THE INVENTION

The present invention relates generally to the packaging of viscid personal care, health and beauty substances packaged in a form designed for personal application and, more particularly, to the recovery and dispensing of the inacessible portion of such a viscid substance originally packaged in stick form.

BACKGROUND OF THE INVENTION

In the personal care, health and beauty industry, it is common for viscid substances, such as lip coloring, moisturizers, crayons and other cosmetic products, as well as hemostatic and other pharmaceutical products, or polishes and other maintenance products, to be packaged in a stick-like shape in a small cylindrical protective case. Typically, these cases are referred to as compacts and, generally, are operable to move the stick between an extended position for personal application and a retracted position for storage.

In most conventional cases of this type, a cup-like base or reservoir supports the stick at its bottom end. The base is connected to a mechanism that is operable to shift the cup axially in the case. This axial movement shifts the opposite, or applicator, end of the stick between the extended application position, in which the applicator end is beyond the case, and back to the retracted position, in which the entire stick is drawn back within the case.

It is important that the base be securely attached to the bottom end of the stick otherwise it will become detached and unable to draw the stick back in to the case for storage. This attachment is commonly achieved by having a significant amount of the bottom end of the stick in the base portion. It is not uncommon for about five to thirty percent of the entire stick to reside in the base. The stick portion located in the base is inaccessible and unusable when the stick is worn down to the base.

For example, a conventional lipstick type compact may include a stick of lip coloring of about 2 inches in total length with about one-half of an inch of this stick being located in the base. In other words, a significant portion, (i.e., about twenty-five percent) of the stick is located in the base of the case and, therefore, is rendered inaccessible and unusable.

Considering the cost of personal care, health and beauty products, it is important to consumers to be able to use as much of the stick as possible. For example, the cost of a stick of lip coloring can be any where in the range of about 10 to 150 dollars per stick, and with as much as twenty-five percent or more of the stick inaccessible and unusable, the cost of the wasted lip coloring becomes significant to the consumer.

Experience has revealed that most cases do not readily dispense the portion of the stick in the base cup, and those that have the ability tend to entail intricate operating mechanisms. One known case that does enable an entire stick of lipstick to be used is disclosed in U.S. Pat. No. 3,677,654 issued to Davis on Jul. 18, 1972 ("the '654 patent"). As disclosed in the '654 patent, the lipstick dispenser includes a cup that supports the lipstick and that is operable to move the majority of the lipstick longitudinally in the case between its use position and storage position. The cup includes a longitudinally moveable bottom to eject the remaining portion of the lipstick located in the cup when it is the only remaining portion of the stick.

A known shortcoming with the dispenser disclosed in the '654 patent is its commercial availability and wide spread acceptance. As mentioned previously, most available dispensers of this packaging type do not have the capability to dispense the portion of the stick in the base. Since dispensers such as that disclosed by the '654 patent tend to include precision working components cooperating to dispense the remaining portion of the stick only when necessary, they tend to be relatively expensive to manufacture in comparison to the conventional dispensers and, therefore, for the most part, have not become widely accepted by the personal health and beauty industry. Another shortcoming includes the fact that the '654 dispenser is not directed to the recovery of the remaining portion of the stick from a conventional type dispenser.

To recover the inaccessible portion of the stick from conventional dispensers, consumers are typically required to use a simple tool, such as a brush or scoop-like accessory, to dig out this portion of the stick and to apply it. This method of recovery is unpleasant, tedious, sloppy and overall time consuming.

An example of variations of one known tool design for removing the inaccessible portion of the stick for the base is disclosed in U.S. Pat. No. 3,343,668 issued to Politzer on Sep. 26, 1967 ("the '668 patent"). The '668 patent discloses a hood that may use different types of projections, such as blades and hooks, to penetrate the lipstick when the hood is slid over the base and to draw the lipstick out of the base as the hood is withdrawn from the base. As disclosed in the '668 patent, the purpose of this design is to clean the remainder of the lipstick from the base in order to insert a refill lipstick. It is not concerned with application of such extracted lipstick after removal. The projections obliterate such portion to the extent that it becomes unpleasant, tedious, sloppy and overall time consuming to apply.

Thus, it is desirable to have a device that, in a pleasant, neat and time efficient manner, both recovers in one process most, if not all, of the inaccessible portion of a stick of a health and beauty product from its original packaging and is able to assist the application of such portion of the stick. It is also desirable that such device be economical to manufacture and use.

SUMMARY OF THE INVENTION

In accordance with present invention, there is provided a device for recovering and dispensing the unusable portion of a viscid, or pasty like, stick substance, such as that of a personal health and beauty product, that is located in the base portion of the original packaging. The device includes a casing having a closed end, an open end and a wall extending between the closed end and the open end. An extractor is associated with the casing and has a predetermined cross-section and an inner surface that cooperate to exert gripping forces to maintain a viscid, pasty stick substance in the extractor. There is a dispenser also associated with the casing and operable to overcome the gripping forces of the extractor to expel a viscid, pasty stick substance being maintained in the extractor.

The extractor includes a predetermined portion of the wall of the casing extending inward from the open end toward the closed end. This wall portion defines the predetermined cross-section and includes the inner surface that cooperates with the predetermined cross-section to exert gripping forces to maintain a viscid, pasty stick substance in the extractor. The extractor may be provided with a guide surface at the open end of the casing to direct a viscid, pasty substance into the extractor.

To enhance the gripping forces, the extractor includes at least one protrusion extending from the inner surface. This protrusion can include a plurality of protrusions extending from the inner surface in a predetermined pattern and/or may have a thread like construction. Each of these protrusions can further include an edge spaced from the inner surface of the extractor to penetrate a viscid, pasty stick substance and a gripping surface located between the edge and the inner surface of the extractor to exert gripping forces on a viscid, pasty stick substance.

The extractor can also include a deflector associated with the inner surface of the extractor to guide a viscid, pasty stick substance in the extractor and to exert gripping forces on a viscid, pasty stick substance in the extractor. An actuator is employed to move the deflector between a first position in which the deflector cooperates with the inner surface of the extractor to guide a viscid, pasty stick substance into the extractor and a second position in which the deflector is spaced from the inner surface to increase gripping forces on a viscid, pasty stick substance.

The extractor can even further include a block that moves in the casing along the wall to increase forces on a viscid, pasty stick substance while in the extractor. This extractor includes a shaft that is operable to move the block to exert a suction type force on a viscid, pasty stick substance in the extractor. The shaft has one end associated with the block and a second end associated with the closed end of the casing. The closed end being operable to move shaft.

A removable cover is associated with the open end of the casing. The cover is removed to expose the extractor. The cover can include a locking mechanism coordinated with the dispenser. The locking mechanism cooperates with the dispenser to maintain a predetermined dispensing position relative to the casing.

BRIEF DESCRIPTION OF THE DRAWINGS

The present invention will be described in connection with the accompanying drawings, which illustrate the preferred embodiments and details of the invention, and in which:

FIG. 1 is a perspective view of a device embodying the present invention to illustrate the cover and main body that is capable of extracting and recovering an inaccessible portion of a viscid, pasty product from its original packaging and later capable of dispensing such product for application;

FIG. 2 is a partially cut away perspective view of the main body to illustrate extracting and recovering the inaccessible portion of the viscid, pasty product from the base of its original packaging;

FIG. 3 is a perspective view of the main body to illustrate dispensing the inaccessible portion of the viscid, pasty product after being removed from its original packaging;

DETAILED DESCRIPTION OF THE PREFERRED EMBODIMENT

Figure 4:
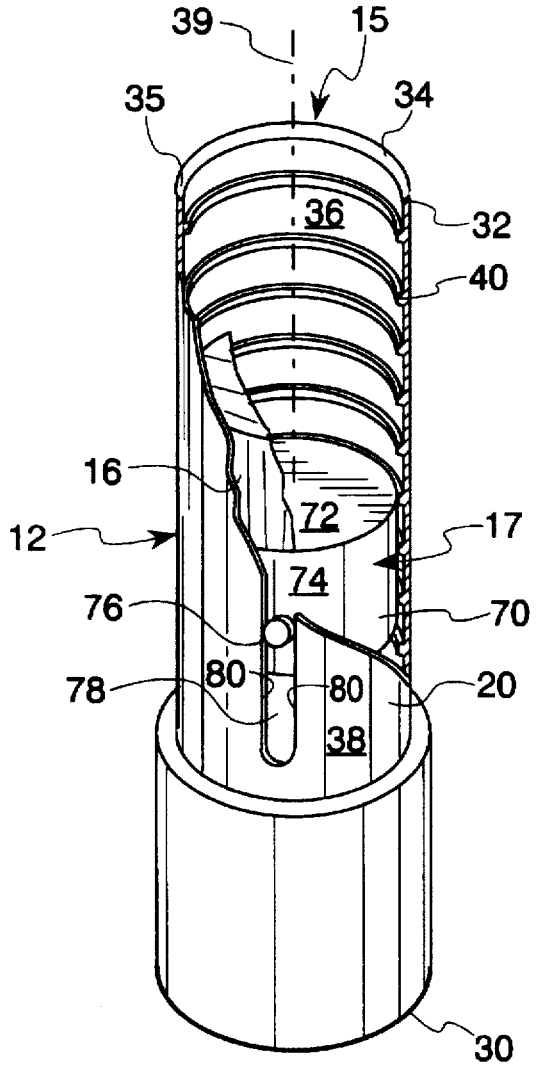
FIG. 4 is a perspective view of the main body partially cut away to illustrate features of an extractor system used to extract the inaccessible portion of the viscid, pasty product from its original packaging.

Referring to FIGS. 1, 2, and 3, there is shown a viscid, or pasty like, substance recovery and dispenser device 10 embodying the features of the present invention. As illustrated, the device 10 includes an elongated casing 12 and a cover 14 designed to telescope over the casing 12. The casing 12 includes an extractor or recovery system 15 adapted to extract and recover an inaccessible portion 16 of a viscid, or pasty like, product, such as lip coloring, moisturizers, crayons and other cosmetic products, as well as hemostatic and other pharmaceutical products, or polishes and other maintenance products, packaged in stick form in its original, conventional packaging 18. The casing 12 also includes a dispenser system 17 to dispense for application the recovered portion 16 of the pasty product.

As described in further detail below, the casing 12 is inserted into the conventional packaging 18 so that the recovery system 15 is able to engage and secure the inaccessible portion 16 of the product (FIG. 2). After securing such portion 16, the recovery system 15 extracts the portion 16 from its conventional packaging 18 as the casing 12 is withdrawn. Once recovered, the extracted portion 16 may then be applied using the dispenser system 17 of the device 10 which is operable to provide controlled dispensing of such portion 16 for application (FIG. 3).

More specifically, the casing 12 includes a closed end 30, which is adapted to be held to manipulate the device 10 during the recovery and dispensing operations, and an open end 32, which is part of the recovery system 15. The casing 12, preferably, is extruded and machined from metal, but may also be molded from any suitable plastic. For example, the casing may be in the range of about one to two inches in length.

The casing 12 has a generally circular cross-section defined by an elongated wall 20. As part of the recovery system 15, the preferred diameter of the cross-section is to be only that generally required to effectively engage the entire inaccessible portion 16 of the product remaining in its original packaging. For example, for a casing that is about one to two inches in length, the diameter of the casing may be in the range of about ¼ to ¾ of an inch.

More particularly, conventional packaging for stick packaged products, such as that illustrated as original packaging 18, typically include an elongated casing 22. Inside such casing 22, there is commonly a longitudinally moveable holder or base cup 24 having a reservoir 26 with a circular cross-section defined by a cup wall 28. To attach the product to the cup 24, one end of it has been inserted into the reservoir 26 with a frictional engagement with the cup wall 28. Then, as the cup 24 travels longitudinally in this casing 22, it also moves the product therewith. Once the product has been consumed, the inaccessible portion 16 comprises that residing in the reservoir 26 of the cup 24.

In accordance with the recovery system 15 of the present invention, the diameter of the circular cross-section defined by the elongated wall 20 of the casing 12 is coordinated to be slightly less than the diameter of the circular cross-section of the reservoir 26 of the cup 24. The relative degree is no more than that necessary to ensure that the wall 20 of the casing 12 engages and slides against the cup wall 28 when the open end 32 of the casing 12 is inserted into the reservoir 26 during the recovery process to engage the product portion 16 and transfer it to the recovery system 15. This coordination of the cross-section is to effectively direct the product into the recovery system 15. For example, in the original packaging 18, the base cup has a cross-section of about one-half inch, and the cross-section of the recovery system defined by the wall of the casing is about 7/16 of an inch.

Conventional packaging may also take the form of different shapes with different cross-sections, such as triangular, oval, square, rectangular, as well as other polygonal forms, for its casing and base cup. In these instances, the portion of the casing of the recovery system of the present invention being adapted for insertion into such other shaped packaging is also similarly coordinated with a predetermined cross-section enabling it to effectively engage and slide against the wall defining the base cup in order to effectively direct and secure the inaccessible portion of the product being recovered in the recovery system.

Referring to FIG. 4, the recovery system 15 includes a leading edge 34 at the open end 32 of the casing 12. The leading edge 34 includes a chamfered surface 35 sloping inward toward the center of the casing 12. As the open end 32 is inserted to the base cup 24 of the conventional packaging 18 during the recovery process, the leading edge 34 scrapes along the base cup wall 28 and the chamfered surface 35 guides the product portion 16 of the product into the casing 12. Tightly packing the product portion 16 into the casing 12 increases the frictional engagement between such portion 16 and the wall 20 of the casing 12, which in turn enhances the extraction capability of the recovery system 15 as the casing 12 is withdrawn from the base cup 24 of the original packaging 18.

As part of the recovery system 15, the casing wall 20 includes an inner surface 36 and an outer surface 38. The inner surface 36 frictionally engages the product portion 16 during the recovery process. The outer surface 38 slides against the cup wall 28. Further, the recovery system 15 includes a plurality of annular ribs 40 extending from the inner surface 36 into the center of the casing 12.

The ribs 40 enhance the gripping operation on the product portion 16 being recovered during the recovery process. More specifically, the ribs 40 penetrate the product portion 16 and grip it as it is being withdrawn from its original packaging. The ribs 40 generally have a predetermined pattern. For example, as illustrated, each rib 40 is spaced equidistance from the adjacent rib 40, and each rib 40 is in a plane perpendicular to the longitudinal axis 39 of the casing 20.

The ribs, however, may also have other predetermined patterns that effectively enhance the gripping application to the recovered portion during the recovery process. For instance, other predetermined patterns may include: foreshortened ribs, i.e., ribs that do not completely encircle about the casing; ribs with random spacing between adjacent ribs; ribs which are pitched from the plane perpendicular to the longitudinal axis 39 so to be only transverse to such axis; and /or ribs in a crisscross type pattern.

Figure 5:
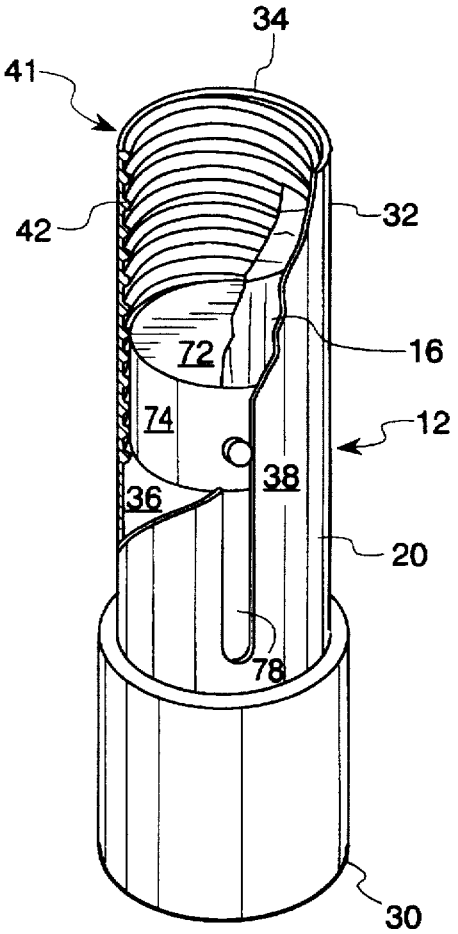
FIG. 5 is a perspective view of the main body partially cut away to illustrate features of an alternate extractor system used to extract the inaccessible portion of the viscid, pasty product from its original packaging.

Referring to FIG. 5, an alternate recovery system 41, which is identical to the recovery system 15 previously described and illustrated in FIG. 4, but with an alternate rib 42 that is similar to a screw thread. More specifically, the rib 42 extends from the inner surface 36 toward the center of casing 12 and winds annularly about the longitudinally axis of the casing 20 from the leading edge 34 for approximately ⅓ to ½ of the length of the casing 20. The rib 42 winds with a predetermined winding angle and pitch, which, preferably, is that used in commercially available screws and nuts. However, the winding angle and pitch may be altered to further enhance the gripping capability depending on the product material being extracted by the device.

In operation, the rib 42 penetrates the product portion 16 being recovered as the casing 12 is inserted rotationally into the base 24 of the original packaging 18. As the casing 12 is withdrawn longitudinally without rotating it, the rib 42 grips the now recovered product portion 16 and aids in the extraction process from the base 24.

Figure 6:
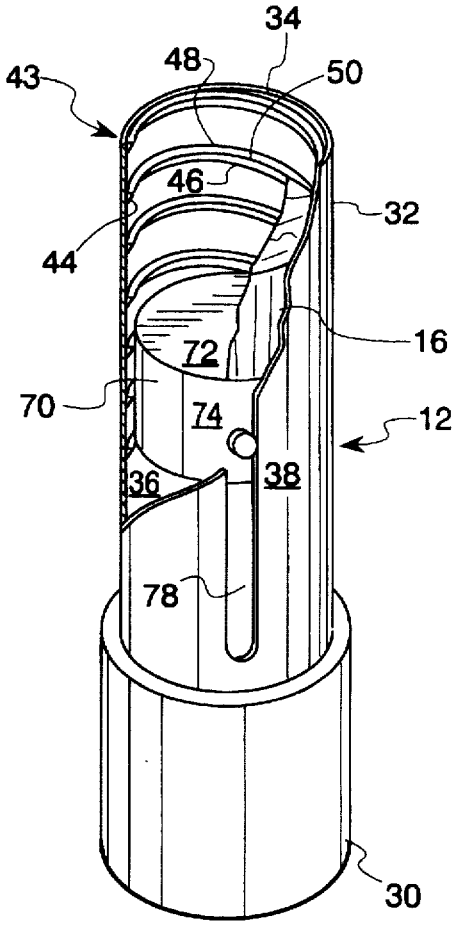
FIG. 6 is a perspective view of the main body partially cut away to illustrate features of an alternate extractor system used to extract the inaccessible portion of the viscid, pasty product from its original packaging.

Referring to FIG. 6, a further alternate recovery system 43, which may be used with the recovery systems 15 and 41 previously described, includes an alternate rib 44 that enhances gripping application during the recovery process. While the previously described ribs 42 and 40 have square (FIG. 4) and rounded (FIG. 5) cross-sections, the rib 44 includes a triangular like cross-section which enhances penetration into, as well as gripping of, the product portion 16 being recovered during the recovery process.

More specifically, the rib 44 includes an insertion surface 46 and a gripping surface 48 that meet at a predetermined angle to form a leading, penetration edge 50. Preferably, this predetermined angle is in the approximate range of about 30 to about 50 degrees with the gripping surface 48 in a plane that is in the range of about 20 degrees above or below the plane perpendicular to the central longitudinal axis extending through the casing 12.

During the recovery process, the casing 12 is inserted into the cup 24 of the original packaging 18, and as this occurs, the insertion surface 46 engages and slides against the product portion 16 and the leading edge 50 penetrates such portion 16 After being fully inserted, the casing 12 is withdrawn, and simultaneously, the leading edge 50 continues to penetrate the product portion 16 and the gripping surface 48 and the inner surface 36 both grip such portion 16 to extract it from the base 24. As mentioned above, the structure of this rib 44 is capable of being used with any of the foregoing described recovery systems.

Figure 7:
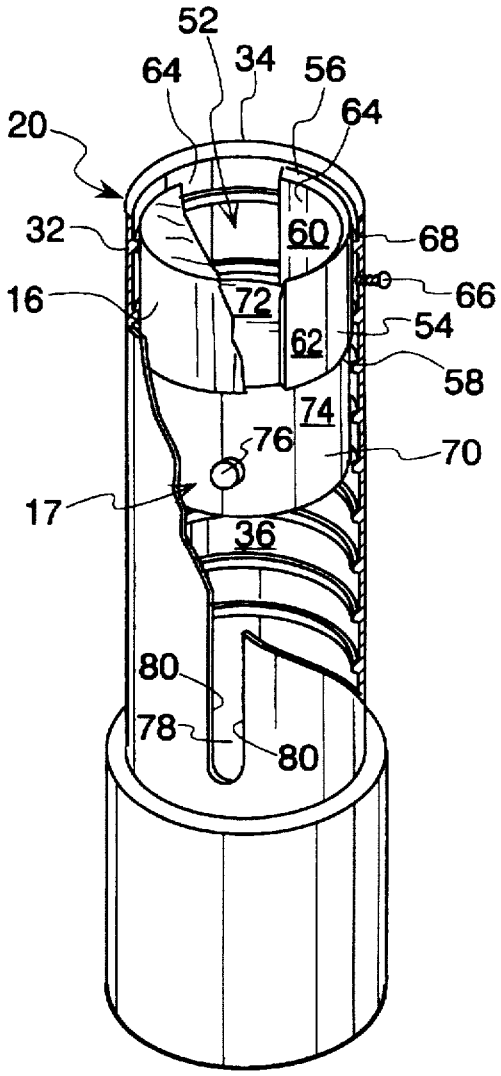
FIG. 7 is a perspective view of the main body partially cut away to illustrate features of an alternate extractor system used to extract the inaccessible portion of the viscid, pasty product from its original packaging.

Referring to FIG. 7, an even further alternate recovery system 52 is illustrated and may be used in conjunction with the features of the foregoing described recovery systems. This recovery system 52 includes a deflection wall 54 that is located inside the casing 12 adjacent the open end 32 and extends annularly about the longitudinal axis of the casing 12. The deflection wall 54 has a curvature that enables it to engage and lay flat against the inner surface 36 of the casing 12. For example, the deflection wall 54 extends in the range of about one-quarter to one-half of the circumferential distance around the longitudinal axis of the casing 12 at the inner surface 36 of the casing wall 20. The deflection wall 54, preferably, has a length in the range of about one-fifth to one-quarter of the longitudinal length of the casing 12 and has a thickness of about that of the casing wall 20.

The deflection wall 54 includes an upper edge 56 and a lower edge 58, which are both chamfered inward toward the center of the casing 12. During the recovery process, the upper edge 56 cooperates with the leading edge 34 of the casing 12 to channel the product portion 16 being recovered into the casing 12. That is, it is preferred that the upper edge 56 and the leading edge 34 be chamfered similarly to form a continuous surface inward toward the casing 12.

The deflection wall 54 includes an inner surface 60, that engages the product portion 16 being recovered, and an outer surface 62, that is capable of engagement with the inner surface 36 of the casing wall 20. To aid the recovery process, the inner surface 36 of the casing wall, as well as the inner surface 60, include ribs 64 and 65, respectively. The construction of the ribs 64 and 65 may of any construction such as those previously described herein. In effect, the deflection wall 54 reduces the cross-section of the casing 12 to increase the frictional engagement between the product portion 16 being recovered and the device 10 inner surfaces 60 and 36 of the deflection wall 54 and the casing wall 20, respectively.

The deflection wall 54 is attached to the casing wall 20 with either a fixed arrangement or an operable arrangement. In the fixed arrangement, the deflection wall 54 is preferably molded integral from the casing wall 20, but may also be made separately and glued or welded directly to the inner surface 36 of the casing wall 20.

On the other hand, in the operable arrangement, the deflection wall 54 is mounted with a screw 66 extending through a threaded bore 68 in the casing wall 20. The screw 66 is rotatably affixed to the deflection wall 54 and is turned in the bore 58 to move the deflection wall 54 inward toward the center of the casing 12 for being able to effect a controlled reduction of the cross-section of the casing 12. For example, once the open end 32 has been inserted in the original packaging during the recovery process, screw 66 is turned to move the deflection wall 54 inward to increase the pressure on the product portion 16, thereby increasing the frictional engagement with such portion 16. The screw 66 is located a sufficient distance longitudinally along the casing 12 from the leading edge 34 so that it can be effectively operated to move the deflection wall 54 while the recovery system is inserted in the original packaging and does not otherwise interfere with the recovery process.

The lower edge 58 of the deflection wall 54 cooperates with a dispensing system 17 of the device 10, which will be described in further detail below. For now, however, it is sufficient to indicate that the dispensing system 17 includes a circular base 70 having an upper surface 72 for engaging the recovered product portion 16. That is, as the base 70 is operated in a controlled manner to move toward the open end 32 of the casing 12, the upper surface 72 engages the recovered portion 16 to dispenses it from the casing 12. As the base 70 engages the deflection wall 54 during the dispensing process, the lower edge 58 deforms the base 70 so that it can pass over and onto the inner surface 60 of the deflection wall 54.

Similarly, the ribs of the recovery systems previously described and illustrated in FIGS. 4–7 also deform the base 70 as it passes over them during the dispensing process. For instance, the insertion surface 46 of the rib 44 (FIG. 6) deforms the base 70 as it passes over. It is preferred that the base be constructed of material, such as rubber, that is sufficiently resilient to pass over the ribs of various profiles, including those ribs having a rounded, square or triangular cross-section. Such resilient material is known by those skilled in the art and is commercially available.

As illustrated in FIGS. 4–7, the dispensing system 17 includes the base 70 having an annular guide surface 74 and an actuator arm 76. The guide surface 74 engages the inner surface 36 of the casing wall 20. The actuator arm 76 is operated manually to slide the base 70 longitudinally in the casing 12.

More particularly, the casing wall 20 includes an elongated slot 78 running along about one-half to two-thirds of the casing wall 20. The actuator arm 76 extends substantially perpendicular from the base 70 through the slot 78 sufficiently enough that one is able to manually operate the arm 76 to move the base 20. The slot 78 is defined by a pair of longitudinally extending edges 80 which are parallel and spaced from one another so to engage the actuator arm 76 to also effectively guide the base 20.

In operation, the actuator arm 76 is manually pushed to move the upper surface 72 into engagement with the recovered product portion 16. Once in engagement, the arm 76 is moved further to dispense such portion 16 from the casing 12 in a controlled manner through the open end 32. The base 70 may also be used to aid the recovery process by moving it to a predetermined position from the open end 32. The general purpose is to reduce the volume of the casing 12 in the recovery system to approximately only that necessary for recovering that particular volume of product in order to ultimately increase the frictional engagement with the product portion 16 being recovered.

Referring to FIG. 1, the cover 14 telescopically extends over the open end 32 of the casing 12. With the cover 14 having a circular cross-section with an inner diameter only slightly larger than the outer diameter of the casing 12, an inner surface 82 of the cover 14 fictionally engages the outer surface 38 of the casing 12. This friction engagement prevents the cover 14 from unintentionally releasing from the casing 12.

The cover 14 also includes an open end edge 84 that engages a step or lip 86 formed in closer relative proximity to the closed end 30 to prevent the cover 14 from being extended too far over the casing 12. This prevents the cover 14 from engaging any amount of the product portion 16 extending beyond the open end 32 of the casing 12. In order to fully extend the cover 14 over the casing 12 to the step 86, the base 70 is moved toward the closed end 30 of the casing 12 to position the actuator pin 76 in a groove 87 in the step 86. In this position, the actuator pin 76 is clear of the cover 14, thereby allowing the edge 84 to engage the step 86.

The cover may alternatively include a longitudinally extending slot substantially similar to that extending through the casing 12. Thus, as the cover is placed on the casing 12, the base 70 is allowed to remain in its last dispensing position since the actuator pin 76 slides through the slot.

Figure 8:
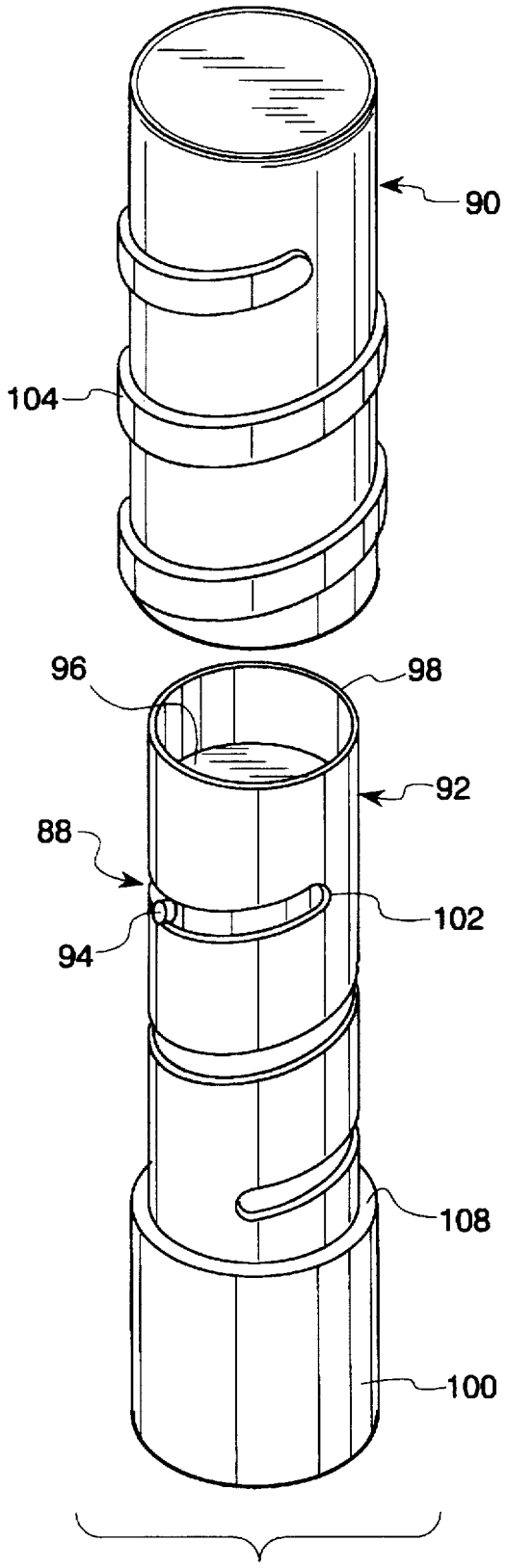
FIG. 8 is a perspective view of another cover and main body to illustrate an alternate dispenser system and an alternate cooperating cover.

Referring to FIG. 8, there is illustrated an alternate dispensing system 88 and cover 90. The alternate system 88 includes an alternate casing 92 that has a spiral slot 102 similar to a screw thread winding at a predetermined pitch and winding angle, instead of the linear elongated slot 78 of the previously described dispensing system 17.

With this alternate system 88, an actuator pin 94 is manually moved through the spiral slot 102 to move the base 96 back and forth between an open end 98 and closed end 100 of the casing 92. The spiral slot 102 preserves the location of the base 96 while the device 10 is in use and storage. Thus, the base 70 does not have to be moved back into engagement with the product for dispensing.

The alternate cover 90 includes a spiral internal slot 104 that allows the cover 90 to accommodate the actuator pin 94. More specifically, the groove 104 is first aligned with the actuator pin 94, and then, the cover 90 is screwed down onto the casing 92 until the casing 92 abuts a step 108 formed in close relative proximity to the closed end 100 of the casing 92. The actuator pin 94, spiral slot 102 and slot 104 cooperate to retain the last dispensing position. As with the previously described cover 14, the cover 90 also has a friction fit with the casing 92 to prevent unintentional removal.

Figure 9:
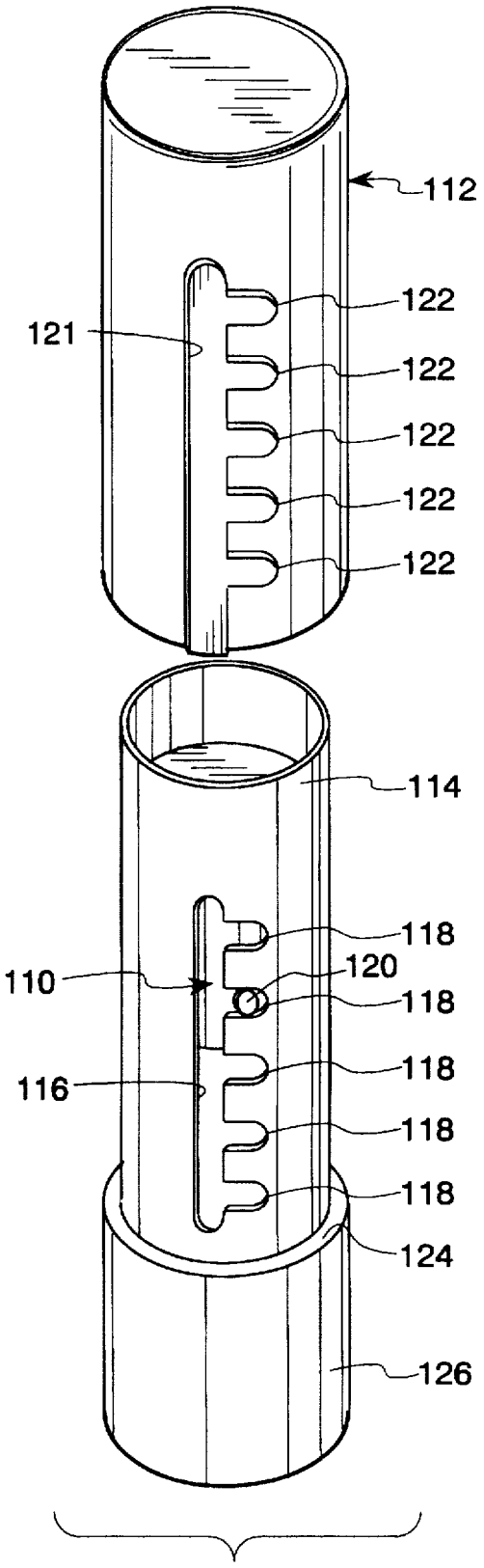
FIG. 9 is a perspective view of another cover and main body to illustrate another alternate dispenser system and another alternate cooperating cover system.

Referring to FIG. 9, there is illustrated an even further alternate dispensing system 110 and cover 112. This system 110 includes an alternate casing 114 that has a main slot 116 extending longitudinally and a number of equidistantly spaced slot extensions 118. The slot extensions 118 each extend perpendicular to the main slot 116. Instead of being perpendicular, the slot extensions 118 may alternatively extend at other angles relative to the main slot 116.

With this alternate system 110, an actuator pin 120 travels longitudinally in the main slot 116 to back and forth to move the base 115 in the casing 114. The actuator pin 120 may be shifted into any one of the slot extensions 118 to preserve a desired position along the casing 114. Thus, the base 115 does not have to be moved far, if at all, for engagement with the product for dispensing.

The alternate cover 112 includes a complementary main slot 121 that also includes a number of equidistantly spaced slot extensions 122. The slot 121 and slot extensions 122 may match the slot 116 and the slot extensions 188 in the casing 114. The cover slots 121 and 122 also allow the cover 112 to pass by the actuator pin 120 as it is being placed in position. More specifically, the cover 112 is first extended over the actuator pin 120 until the cover 112 abuts a step 124 formed in close relative proximity to a closed end 126 of the casing 112. The cover 112 is then rotated until the actuator pin 120 is sitting in the aligned slot extension 122. The slot extensions 118 and 122 cooperate to retain the position of the actuator pin 120. In addition to that provided by the actuator pin 120 in the slot extensions 118 and 122, the cover 112 has a friction fit with the casing 114 to resist movement.

Figure 10:
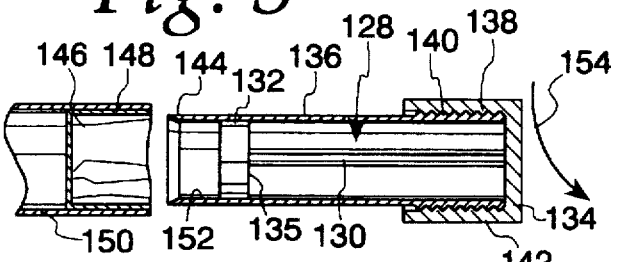
FIG. 10 is a longitudinal cross-sectional view of another main body to illustrate features of another alternate extraction system used to extract the inaccessible portion of the viscid, pasty product from its original packaging.
Figure 11:
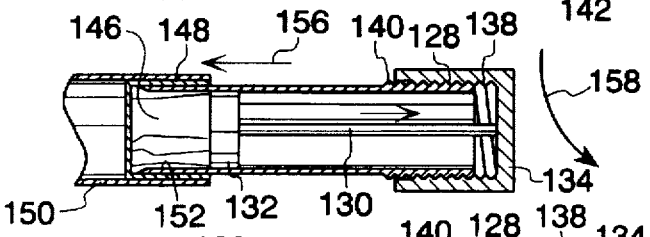
FIG. 11 is a longitudinal cross-sectional view of the main body of FIG. 10 to illustrate the extraction of the inaccessible portion of the viscid, pasty product from its original packaging.
Figure 12:
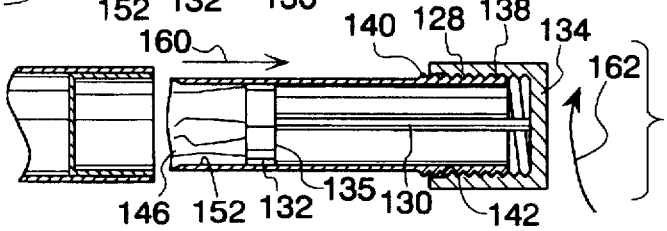
FIG. 12 is a longitudinal cross-sectional view of the main body of FIG. 10 to further illustrate the extraction of the inaccessible portion of the viscid, pasty product from its original packaging.

Referring to FIGS. 10–12, there is illustrated an alternate cooperating recovery and dispensing system 128. This system 128 is capable of being employed independently or in conjunction with any one or more of the foregoing recovery systems described herein. This system 128 includes an alternative casing 136 having an open end 144, through which the recovery and dispensing processes occur, and a second, opposite end 138 covered with an operable cover 134. Inside the casing 136, there is a dispensing block or base 132 and a shaft 130, which are operated to draw on the product portion 146 by way of creating suction during the recovery process and to push such recovered portion 146 during the dispensing process.

More specifically, the shaft 130 connects the base 132 to the operable cover 134. That is, one end of the shaft 130 is permanently affixed to the base 132 at its rear side 135 while the opposite end 138 is permanently attached to the operable cover 134 at its inside. At the opposite end 138, the casing 136 has threads 140 on its outside, and the cover 134 has threads 142 on its inside. As the cover 134 is rotated, the threads 140 and 142 cooperate to move the cover 134 longitudinally to in turn move the base 132 longitudinally. The threads 140 and 142, shaft 130 and cover 134 should be designed to produce a minimum range of longitudinal movement for the base 132 between at least a maximum dispensing even with the open end 144 and a maximum recovery position within the casing 136 spaced from the open end 144 sufficient to hold the desired volume of product portion and to create the necessary drawing suction during the recovery process. It is preferred that this maximum recovery position be a position slightly beyond that necessary to hold the desired volume of product portion being recovered.

In operation, the cover 134 is turned to move the base 132 to an initial recovery position in which it is spaced from the open end 144 only that distance required to create just enough room at the open end 144 of the casing 136 to hold the desired product portion 146 being recovered. For example, such distance is indicated in FIG. 10, as well as the rotation of the cover 134 as indicated by the arrow marked with reference number 154. The initial recovery position may be estimated, or alternatively, the casing 136 may include predetermined markings so that one can easily move the cover 134 to this recovery position. It is preferred to underestimate the amount of product portion to be recovered from the original packaging in order to tightly pack such portion in the casing 136.

After setting the initial recovery position, the open end 144 of the casing 136 is inserted into the base 148 of the original packaging 150, e.g., as indicated by the arrow marked with reference number 156 (FIG. 11). Once inserted, the cover 134 is rotated to move the base 132 away from the recovered portion 146, e.g., as indicated by the arrow marked with reference number 158 (FIG. 11). This movement of the base 132 creates a suction type force that aids the frictional engagement between the product portion 146 and an inner surface 152 of the casing 136 in removal of such portion 146 from the original packaging 150 (FIG. 11). After the system 128 has been set for removal, the casing 136 is withdrawn from the base 148 of the original packaging 150 to extract the unusable product portion 146, e.g., as indicated by the arrow marked with reference number 160 (FIG. 12).

The base 132 is made of any known commercially available resilient material, such as rubber, that effectively seals the engagement between itself and the inner surface 152 of the casing 136 to create the suction type force for a sufficient period of time during the removal process. It is preferred to perform the removal process as soon as possible after creating the suction in order to take full advantage of such feature.

To dispense the recovered product portion 146, the cover 134 is rotated the opposite direction to move the base 132 into contact with the recovered portion 146 and to further force such portion 146 from the open end 144 of the casing 136, e.g., as indicated by the arrow marked with reference number 162 (FIG. 12). Other aspects of the foregoing recovery systems, such as the chamfered leading edges, as well as the rib structures, may be used in conjunction with this combined recovery and dispensing system 128.

Further, with any of the foregoing systems described herein, the recovery process is enhanced by lowering the temperature of the viscid, pasty substance below ambient temperature, thereby further solidifying the product substance. The temperature lowering may be done before or even during the recovery process.

It will be understood that various changes in the details, materials and arrangement of parts and systems which have been herein described and illustrated in order to explain the nature of the present invention may be made by those skilled in the art within the principle and scope of the present invention as expressed in the appended claims.

What is claimed is:

1. A device for recovering a pasty cosmetic substance from a cosmetic holder and for preserving and dispensing the recovered substance for future application comprising:

a casing having a closed end, an open end and a wall extending between the closed end and the open end;

an extractor associated with the casing and having a first predetermined cross-section and an inner surface which cooperate to exert gripping forces to recover and maintain a pasty substance in the extractor during and after recovery thereof; and a dispenser associated with the casing and being capable of operating to assist the extractor to exert gripping forces during recovery and to overcome the gripping forces after recovery to expel a pasty substance being maintained in the extractor in a substantially controlled manner through the open end of the casing for future application.

2. A device in accordance with claim 1 wherein the extractor further comprises a predetermined portion of the wall of the casing extending inward, the wall portion defining a second predetermined cross-section for the extractor and cooperating with the inner surface of the extractor to exert gripping forces to recover and maintain a pasty substance in the extractor.

3. A device in accordance with claim 2 wherein the extractor further comprises a guide surface at the open end of the casing to direct a pasty substance into the extractor.

4. A device in accordance with claim 1 wherein the extractor further comprises at least one protrusion extending from the inner surface to exert additional gripping forces on a pasty substance and to cooperate with the dispenser to expel the pasty substance being maintained in the extractor.

5. A device in accordance with claim 4 wherein the at least one protrusion includes a plurality of protrusions extending from the inner surface in a predetermined pattern to exert gripping forces on a pasty substance.

6. A device according to claim 4 wherein the at least one protrusion has a thread like construction extending from the inner surface to exert gripping forces on a pasty substance.

7. A device in accordance with claim 4 wherein the at least one protrusion further comprises an edge spaced from the inner surface of the extractor to penetrate slightly a pasty substance and a gripping surface located between the edge and the inner surface of the extractor to exert gripping forces on a pasty substance.

8. A device in accordance with claim 1 wherein the extractor further comprises a deflector being dimensioned to extend about a longitudinal axis of the casing and being associated with the inner surface of the extractor to guide a pasty substance into the extractor and to exert gripping forces on a pasty substance in the extractor.

9. A device in accordance with claim 8 wherein the extractor further comprises an actuator associated with the deflector and being operable to move the deflector between a first position in which the deflector cooperates with the inner surface of the extractor to guide a pasty substance into the extractor and a second position toward the longitudinal axis of the casing in which the deflector is spaced from the inner surface such that at least a portion of the extractor has a second cross-section less than the first predetermined cross-section of the extractor to increase forces on a pasty substance.

10. A device in accordance with claim 1 wherein the dispenser comprises a dispensing base being movable in the casing along the wall toward the open end of the casing to a predetermined position relative to the open end to cooperate with the extractor to exert forces to recover and maintain a pasty substance in the extractor and toward the open end of the casing to dispense in a controlled manner substantially all of the pasty substance being maintained in the extractor.

11. A device in accordance with claim 10 wherein the dispenser further comprises an actuator arm for shifting the dispensing base to assist the extractor to exert forces to recover and maintain a pasty substance in the extractor, the arm having a first end associated with the dispensing base and a second end associated with the closed end of the casing, the closed end of the casing being operable to move the arm.

12. A device in accordance with claim 1 further comprising a cover removably associated with the open end of the casing, the cover being removed to expose the extractor.

13. A device in accordance with claim 12 wherein the cover comprises a locking mechanism coordinated with the dispenser, the locking mechanism and the dispenser cooperate to maintain generally a last used dispensing position relative to the open end of the casing such that a portion of a recovered pasty substance remains generally adjacent the open end for future application.

14. A recovery and dispensing device for pasty substances packaged in a generally stick-like form comprising:

a holder having a first predetermined cross-section;

a pasty substance having a generally stick-like form in the holder;

a casing having a closed end, an open end and a wall extending between the closed end and the open end;

an extractor being defined by the wall of the casing and having an inner surface and a second predetermined cross-section slightly less than the first predetermined cross-section of the holder such that the extractor is capable of being inserted in the holder, the inner surface being capable of gripping the pasty substance in the holder when the extractor has been inserted into the holder to extract the pasty substance from the holder and to maintain the pasty substance in the extractor during and after removal of the extractor from the holder; and a dispenser associated with the casing and being operable to assist the extractor to exert gripping forces during recovery of a pasty substance and to overcome the gripping forces of the extractor to selectively expel the pasty substance from the extractor for controlled application after being removed from the holder.

15. A device in accordance with claim 14 wherein the extractor further comprises a predetermined portion of the wall of the casing extending inward from the inner surface, the wall portion defining a third predetermined cross-section less than the second predetermined cross-section of the extractor such that the wall portion and the inner surface of the extractor exert gripping forces to remove the pasty substance from the holder and to maintain the pasty substance in the extractor.

16. A device in accordance with claim 15 wherein the extractor further comprises a guide surface at the open end of the casing to direct the pasty substance into the extractor as the extractor is inserted into the holder.

17. A device in accordance with claim 14 wherein the extractor further comprises at least one protrusion extending from the inner surface to exert additional gripping forces on the pasty substance to extract the pasty substance from the holder and to cooperate with the dispenser to expel the pasty substance being maintained in the extractor.

18. A device in accordance with claim 17 wherein at least one protrusion further comprises an edge spaced from the inner surface of the extractor to slightly penetrate the pasty substance in the holder and a gripping surface located between the edge and the inner surface of the casing to exert gripping forces on the pasty substance to extract the pasty substance from the holder.

19. A device in accordance with claim 14 wherein the extractor further comprises a deflector extending about a longitudinal axis of the casing and being moveable between a first position in which the deflector guides the pasty substance from the holder into the extractor and a second position in which the deflector is spaced from the inner surface such that at least a portion of the extractor has a third cross-section less than the second predetermined cross-section of the extractor to increase gripping forces on the pasty substance to extract the pasty substance from the holder and to maintain the pasty substance in the extractor.

20. A device in accordance with claim 14 wherein the dispenser further comprises a base in the casing being capable of moving in the casing along the wall such that the gripping forces of the extractor are increased to remove the pasty substance and to maintain the pasty substance in the extractor.

21. A method for recovering a generally unusable portion of a pasty substance from its packaging and dispensing the recovered portion for further application comprising:

providing a holder having a pasty substance therein;

providing a casing having a closed end, an open end and a wall extending between the closed end and the open end;

providing an extractor associated with the casing and having an inner surface, the extractor being capable of exerting gripping forces on the pasty substance to extract the pasty substance from the holder and to maintain the pasty substance in the extractor;

providing a dispenser associated with the casing, the dispenser being capable of cooperating with the extractor to increase gripping forces on the pasty substance during recovery of the pasty substance and of overcoming the gripping forces of the extractor to selectively expel the pasty substance being maintained in the extractor for controlled application;

inserting the extractor into the holder between the pasty substance and the holder such that the pasty substance is transferred from the holder to the extractor;

exerting gripping forces with the extractor on the pasty substance in the holder to maintain the pasty substance in the extractor;

removing the extractor from the holder to remove the pasty substance from the holder with the extractor; and operating the dispenser to overcome the gripping forces to expel the pasty substance transferred to and maintained in the extractor for controlled application.

22. A method in accordance with claim 21 which further comprises the step of rotating the extractor while the extractor is being inserted into the holder.

23. A method in accordance with claim 22 which further comprises the step of providing an extractor having a second gripping surface to exert forces on the pasty substances to remove the pasty substance from the holder and to maintain the removed pasty substance in the extractor.

24. A method in accordance with claim 21 which further comprises the steps of providing an extractor having a block being capable of moving in the casing along the wall of the casing to create a suction type force on the pasty substance to remove the pasty substances from the holder and to maintain the pasty substance in the extractor once removed and moving the block away from the pasty substance in extractor to create the suction type force on the pasty substance before removing the extractor from the holder.

25. A method in accordance with claim 21 which further comprises the step of lowering the temperature of the pasty substance below ambient prior to the step of removing the extractor from the holder.

* * * * *